US006684642B2

(12) United States Patent
Willis et al.

(10) Patent No.: US 6,684,642 B2
(45) Date of Patent: Feb. 3, 2004

(54) GAS TURBINE ENGINE HAVING A MULTI-STAGE MULTI-PLANE COMBUSTION SYSTEM

(75) Inventors: Jeffrey W. Willis, Lexington, KY (US); Guillermo Pont, Los Angeles, CA (US); Benjamin E. Toby, Sierra Madre, CA (US); Robert D. McKeirnan, Jr., Westlake Village, CA (US)

(73) Assignee: Capstone Turbine Corporation, Chatsworth, CA (US)

( * ) Notice: Subject to any disclaimer, the term of this patent is extended or adjusted under 35 U.S.C. 154(b) by 0 days.

(21) Appl. No.: 10/171,684

(22) Filed: Jun. 17, 2002

(65) Prior Publication Data

US 2002/0148232 A1 Oct. 17, 2002

Related U.S. Application Data

(63) Continuation of application No. 09/512,986, filed on Feb. 24, 2000.

(51) Int. Cl.[7] ..... F02C 3/00
(52) U.S. Cl. ..... 60/746; 60/737
(58) Field of Search ..... 60/746, 734, 733, 60/749, 737, 804

(56) References Cited

U.S. PATENT DOCUMENTS

| | | | |
|---|---|---|---|
| 1,698,963 | A | 1/1929 | Oslund et al. |
| 1,826,776 | A | 10/1931 | Gunther |
| 1,874,970 | A | 8/1932 | Hall |
| 2,593,849 | A | 4/1952 | Clarke et al. |
| 2,829,494 | A | 4/1958 | Christensen |
| 2,946,185 | A | 7/1960 | Bayer |
| 2,982,099 | A | 5/1961 | Carlisle et al. |
| 3,658,691 | A | 4/1972 | Keith et al. |
| 3,676,328 | A | 7/1972 | Dalson et al. |
| 3,676,329 | A | 7/1972 | Dalson et al. |
| 3,691,762 | A | 9/1972 | Ryberg et al. |
| 3,765,171 | A | 10/1973 | Hagen et al. |
| 3,797,231 | A | 3/1974 | McLean |
| 3,846,979 | A | 11/1974 | Pfefferle |
| 3,866,413 | A | 2/1975 | Sturgess |
| 3,875,047 | A | 4/1975 | Dalson et al. |
| 3,893,297 | A | 7/1975 | Tatem, Jr. et al. |
| 3,895,488 | A | 7/1975 | Koch |
| 3,914,090 | A | 10/1975 | Pfefferle |

(List continued on next page.)

FOREIGN PATENT DOCUMENTS

| | | |
|---|---|---|
| EP | 0 445 652 A1 | 9/1991 |
| GB | 2239056 | 6/1991 |

OTHER PUBLICATIONS

Gessaman et al., Industrial Trent Dry Low Emissions Gas Fuel Control System, *ASME*, 2001–GT–0024, pp. 1–5 (Presented at the International Gas Turbine & Aeroengine Congress & Exhibition, New Orleans, LA, Jun. 4–7, 2001).

U.S. patent application Ser. No. 09/207,817, Gilbreth et al., filed Dec. 1998.

*Primary Examiner*—Michael Koczo
(74) *Attorney, Agent, or Firm*—Sterne, Kessler, Goldstein & Fox PLLC

(57) ABSTRACT

A low emissions combustion system with a plurality of tangential fuel injectors to introduce a fuel/air mixture at the combustor dome end of an annular combustion chamber in two spaced injector planes. Each of the spaced injector planes includes multiple tangential fuel injectors delivering premixed fuel and air into the annular combustor. A generally skirt-shaped flow control baffle extends from the tapered inner liner into the annular combustion chamber downstream of the fuel injector planes. A plurality of air dilution holes in the tapered inner liner underneath the flow control baffle introduce dilution air into the annular combustion chamber while another plurality of air dilution holes in the cylindrical outer liner introduces more dilution air downstream from the flow control baffle.

13 Claims, 5 Drawing Sheets

U.S. PATENT DOCUMENTS

| | | | |
|---|---|---|---|
| 3,923,011 | A | 12/1975 | Pfefferle |
| 3,928,961 | A | 12/1975 | Pfefferle |
| 3,940,923 | A | 3/1976 | Pfefferle |
| 3,973,390 | A | 8/1976 | Jeroszko |
| 3,975,900 | A | 8/1976 | Pfefferle |
| 3,982,879 | A | 9/1976 | Pfefferle |
| 4,007,002 | A | 2/1977 | Schirmer |
| 4,011,839 | A | 3/1977 | Pfefferle |
| 4,019,316 | A | 4/1977 | Pfefferle |
| 4,040,252 | A | 8/1977 | Mosier et al. |
| 4,044,553 | A | 8/1977 | Vaught |
| 4,065,917 | A | 1/1978 | Pfefferle |
| 4,073,716 | A | 2/1978 | Pfefferle et al. |
| 4,094,142 | A | 6/1978 | Pfefferle |
| 4,112,675 | A | 9/1978 | Pillsbury et al. |
| 4,118,171 | A | 10/1978 | Flanagan et al. |
| 4,179,881 | A | 12/1979 | Faucher et al. |
| 4,192,139 | A | 3/1980 | Buchheim |
| 4,239,499 | A | 12/1980 | Pfefferle |
| 4,276,203 | A | 6/1981 | Pfefferle |
| 4,285,193 | A | 8/1981 | Shaw et al. |
| 4,287,090 | A | 9/1981 | Pfefferle |
| 4,295,818 | A | 10/1981 | Angwin et al. |
| 4,337,028 | A | 6/1982 | Angwin et al. |
| 4,341,662 | A | 7/1982 | Pfefferle |
| 4,384,843 | A | 5/1983 | Pfefferle |
| 4,402,662 | A | 9/1983 | Pfefferle |
| 4,407,785 | A | 10/1983 | Pfefferle |
| 4,433,540 | A | 2/1984 | Cornelius et al. |
| 4,439,136 | A | 3/1984 | Pfefferle |
| 4,470,262 | A | 9/1984 | Shekleton |
| 4,509,333 | A | 4/1985 | Nussdorfer et al. |
| 4,586,328 | A | 5/1986 | Howald |
| 4,603,547 | A | 8/1986 | Pfefferle et al. |
| 4,638,636 | A | 1/1987 | Cohen |
| 4,646,707 | A | 3/1987 | Pfefferle |
| 4,698,963 | A | 10/1987 | Taylor |
| 4,726,181 | A | 2/1988 | Pillsbury |
| 4,735,052 | A | 4/1988 | Maeda et al. |
| 4,773,368 | A | 9/1988 | Pfefferle |
| 4,787,208 | A | 11/1988 | DeCorso |
| 4,811,707 | A | 3/1989 | Pfefferle |
| 4,819,595 | A | 4/1989 | Pfefferle |
| 4,864,811 | A | 9/1989 | Pfefferle |
| 4,891,936 | A | 1/1990 | Shekleton et al. |
| 4,896,636 | A | 1/1990 | Pfefferle |
| 4,905,658 | A | 3/1990 | Pfefferle |
| 4,910,957 | A | 3/1990 | Moreno et al. |
| 4,918,915 | A | 4/1990 | Pfefferle |
| 4,928,479 | A | 5/1990 | Shekleton et al. |
| 4,928,481 | A | 5/1990 | Joshi et al. |
| 4,982,570 | A | 1/1991 | Waslo et al. |
| 4,996,838 | A | 3/1991 | Melconian |
| 5,000,004 | A | 3/1991 | Yamanaka et al. |
| 5,025,622 | A | 6/1991 | Melconian |
| 5,051,241 | A | 9/1991 | Pfefferle |
| 5,054,280 | A | 10/1991 | Ishibashi et al. |
| 5,063,745 | A | 11/1991 | Shekleton et al. |
| 5,070,700 | A | 12/1991 | Mowill |
| 5,076,053 | A | 12/1991 | McVey et al. |
| 5,079,911 | A | 1/1992 | Kumakura |
| 5,099,644 | A | 3/1992 | Sabla et al. |
| 5,101,620 | A | 4/1992 | Shekleton et al. |
| 5,113,647 | A | 5/1992 | Shekleton |
| 5,127,221 | A | 7/1992 | Beebe |
| 5,146,881 | A | 9/1992 | Pfefferle |
| 5,156,002 | A | 10/1992 | Mowill |
| 5,161,366 | A | 11/1992 | Beebe |
| 5,163,284 | A | 11/1992 | Shekleton |
| 5,167,122 | A | 12/1992 | Shekleton |
| 5,199,265 | A | 4/1993 | Borkowicz |
| 5,205,117 | A | 4/1993 | Shekleton et al. |
| 5,207,064 | A | 5/1993 | Ciokajlo et al. |
| 5,214,911 | A | 6/1993 | Shekleton |
| 5,222,357 | A | 6/1993 | Eddy et al. |
| 5,234,882 | A | 8/1993 | Pfefferle |
| 5,235,813 | A | 8/1993 | McVey et al. |
| 5,235,814 | A | 8/1993 | Leonard |
| 5,261,224 | A | 11/1993 | Shekleton et al. |
| 5,321,049 | A | 6/1994 | Smith et al. |
| 5,331,814 | A | 7/1994 | Sandelis |
| 5,342,591 | A | 8/1994 | Pfefferle |
| 5,376,345 | A | 12/1994 | Pfefferle |
| 5,412,938 | A | 5/1995 | Keller |
| 5,417,933 | A | 5/1995 | Pfefferle |
| RE34,962 | E | 6/1995 | Shekleton et al. |
| 5,421,154 | A | 6/1995 | Pfefferle et al. |
| 5,437,152 | A | 8/1995 | Pfefferle |
| 5,440,872 | A | 8/1995 | Pfefferle |
| 5,452,574 | A | 9/1995 | Cowell et al. |
| 5,453,003 | A | 9/1995 | Pfefferle |
| 5,466,651 | A | 11/1995 | Pfefferle |
| 5,479,781 | A | 1/1996 | Fric et al. |
| 5,592,819 | A | 1/1997 | Ansart et al. |
| 5,611,684 | A | 3/1997 | Spielman |
| 5,622,054 | A | 4/1997 | Tingle |
| 5,685,156 | A | 11/1997 | Willis et al. |
| 5,735,126 | A | 4/1998 | Schulte-Werning |
| 5,752,380 | A | 5/1998 | Bosley et al. |
| 5,850,732 | A | 12/1998 | Willis et al. |
| 5,894,720 | A | 4/1999 | Willis et al. |
| 6,016,658 | A | 1/2000 | Willis et al. |
| 6,274,945 | B1 | 8/2001 | Gilbreth et al. |
| 6,453,658 | B1 | 9/2002 | Willis et al. |

| MODE | % Power | % Max FAR |
|---|---|---|
| 6 Injectors | 67 -100 | 70 - 100 |
| 4 Injectors | 44 - 67 | 45 - 70 |
| 3 Injectors | 5 - 44 | 36 - 45 |
| 2 Injectors | Idle - 5 | Up to 36 |

GAS TURBINE ENGINE HAVING A MULTI-STAGE MULTI-PLANE COMBUSTION SYSTEM

TECHNICAL FIELD

This invention relates to the general field of combustion systems and more particularly to a multi-stage, multi-plane, low emissions combustion system for a small gas turbine engine.

BACKGROUND OF THE INVENTION

In a small gas turbine engine, inlet air is continuously compressed, mixed with fuel in an inflammable proportion, and then contacted with an ignition source to ignite the mixture which will then continue to bum. The heat energy thus released then flows in the combustion gases to a turbine where it is converted to rotary energy for driving equipment such as an electrical generator. The combustion gases are then exhausted to atmosphere after giving up some of their remaining heat to the incoming air provided from the compressor.

Quantities of air greatly in excess of stoichiometric amounts are normally compressed and utilized to keep the combustor liner cool and dilute the combustor exhaust gases so as to avoid damage to the turbine nozzle and blades. Generally, primary sections of the combustor are operated near stoichiometric conditions which produce combustor gas temperatures up to approximately four thousand (4,000) degrees Fahrenheit. Further along the combustor, secondary air is admitted which raises the air-fuel ratio (AFR) and lowers the gas temperatures so that the gases exiting the combustor are in the range of two thousand (2,000) degrees Fahrenheit.

It is well established that NOx formation is thermodynamically favored at high temperatures. Since the NOx formation reaction is so highly temperature dependent, decreasing the peak combustion temperature can provide an effective means of reducing NOx emissions from gas turbine engines as can limiting the residence time of the combustion products in the combustion zone. Operating the combustion process in a very lean condition (i.e., high excess air) is one of the simplest ways of achieving lower temperatures and hence lower NOx emissions. Very lean ignition and combustion, however, inevitably result in incomplete combustion and the attendant emissions which result therefrom. In addition, combustion processes are difficult to sustain at these extremely lean operating conditions. Further, it is difficult in a small gas turbine engine to achieve low emissions over the entire operating range of the turbine.

Significant improvements in low emissions combustion systems have been achieved, for example, as described in U.S. Pat. No. 5,850,732 issued Dec. 22, 1998 and entitled "Low Emissions Combustion System" assigned to the same assignee as this application and incorporated herein by reference. With even greater combustor loading and the need to keep emissions low over the entire operating range of the combustor system, the inherent limitations of a single-stage, single-plane, combustion system become more evident.

SUMMARY OF THE INVENTION

The low emissions combustion system of the present invention includes a generally annular combustor formed from a cylindrical outer liner and a tapered inner liner together with a combustor dome. A plurality of tangential fuel injectors introduces a fuel/air mixture at the combustor dome end of the annular combustion chamber in two spaced injector planes. Each of the injector planes includes multiple injectors delivering premixed fuel and air into the annular combustor. A generally skirt-shaped flow control baffle extends from the tapered inner liner into the annular combustion chamber. A plurality of air dilution holes in the tapered inner liner underneath the flow control baffle introduce dilution air into the annular combustion chamber. In addition, a plurality of air dilution holes in the cylindrical outer liner introduces more dilution air downstream from the flow control baffle.

The fuel injectors extend through the recuperator housing and into the combustor through an angled tube which extends between the outer recuperator wall and the inner recuperator wall and then through the cylindrical outer liner of the combustor housing into the interior of the annular combustion chamber. The fuel injectors generally comprise an elongated injector tube with the outer end including a coupler having at least one fuel inlet tube. Compressed combustion air is provided to the interior of the elongated injector tube from openings therein which receive compressed air from the angled tube around the fuel injector which is open to the space between the recuperator housing and the combustor.

The present invention allows low emissions and stable performance to be achieved over the entire operating range of the gas turbine engine. This has previously only been obtainable in large, extremely complicated, combustion systems. This system is significantly less complicated than other systems currently in use.

BRIEF DESCRIPTION OF THE DRAWINGS

Figure 1:
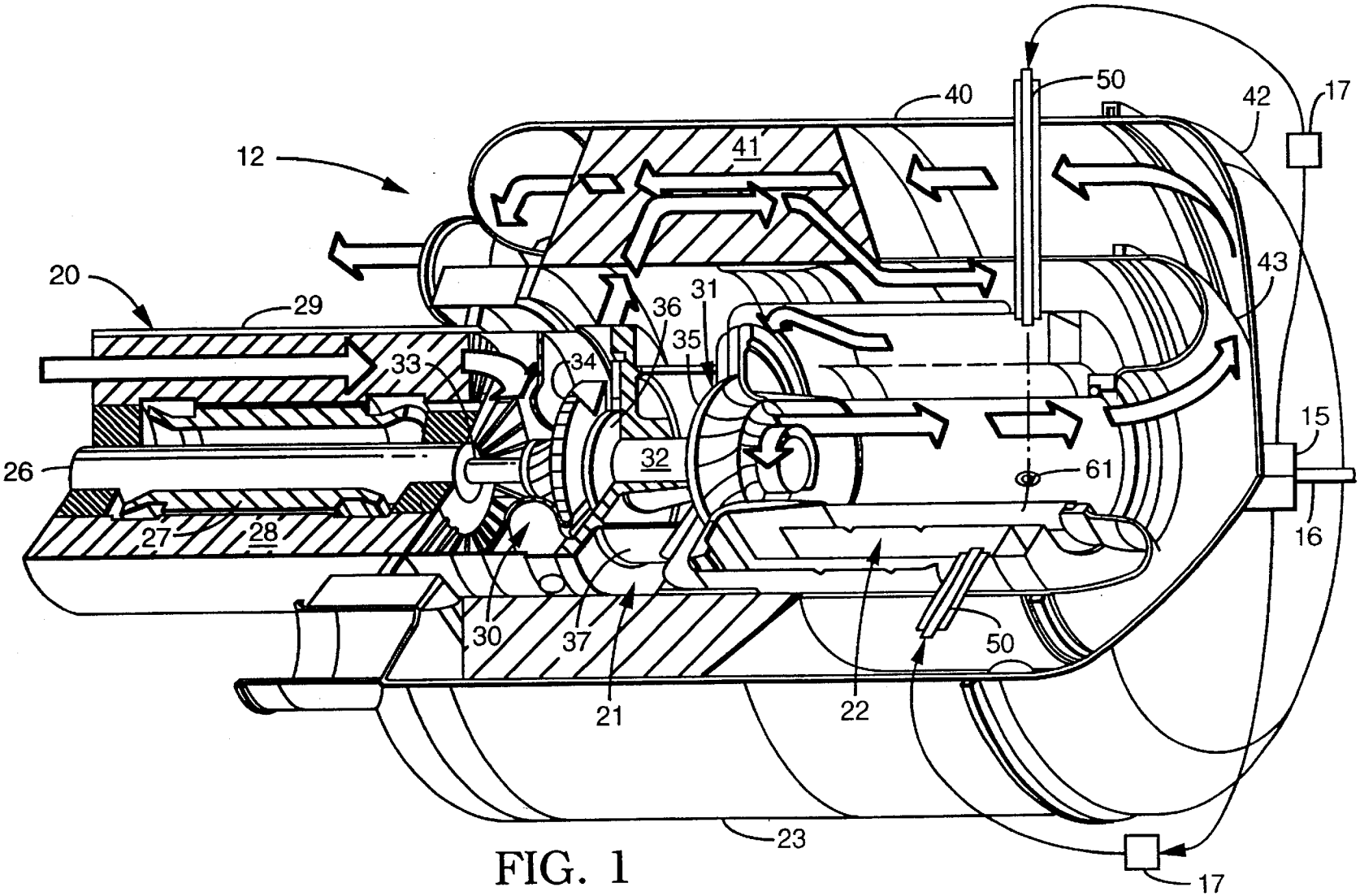
Figure 2:
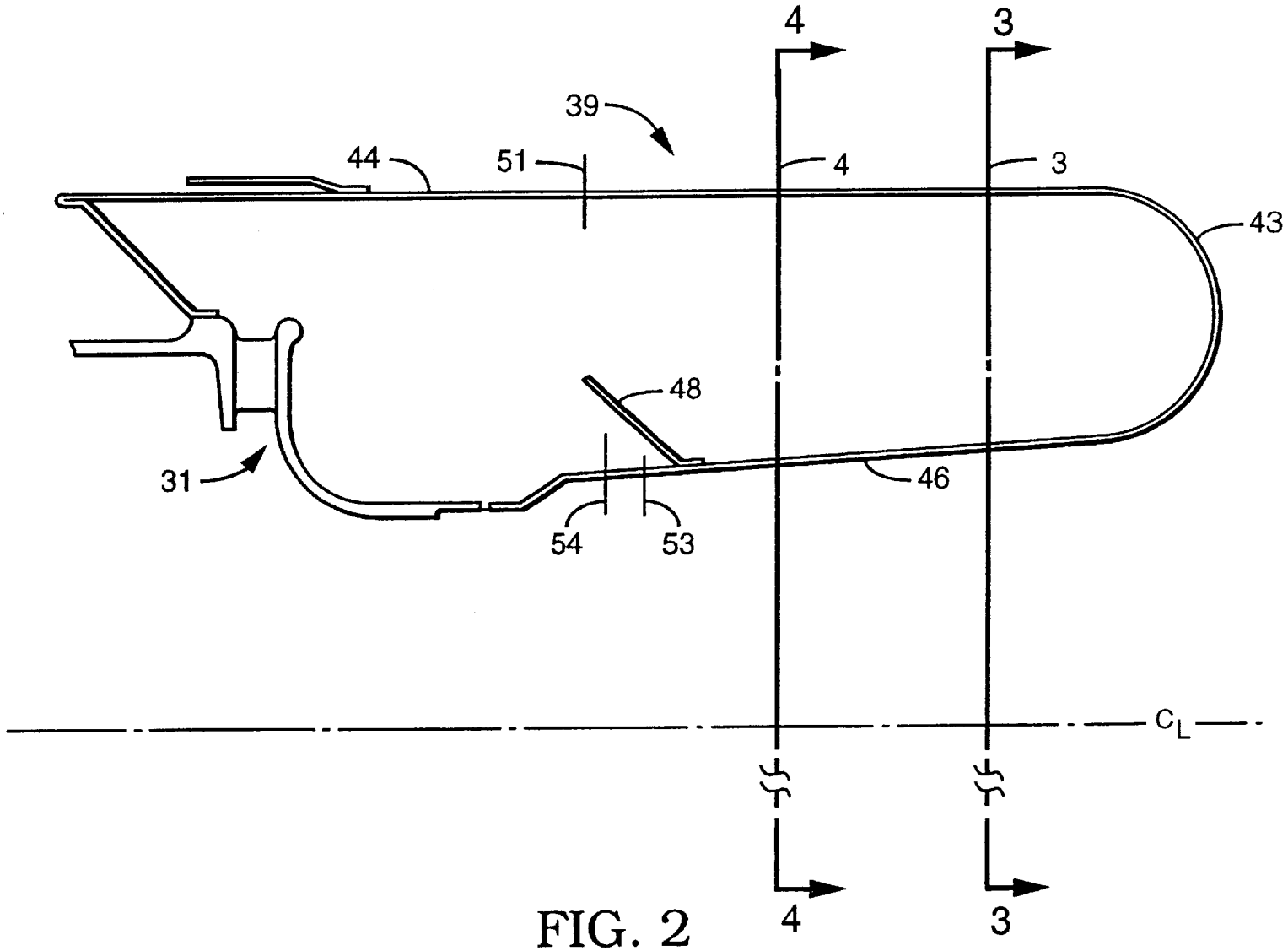
Figure 3:
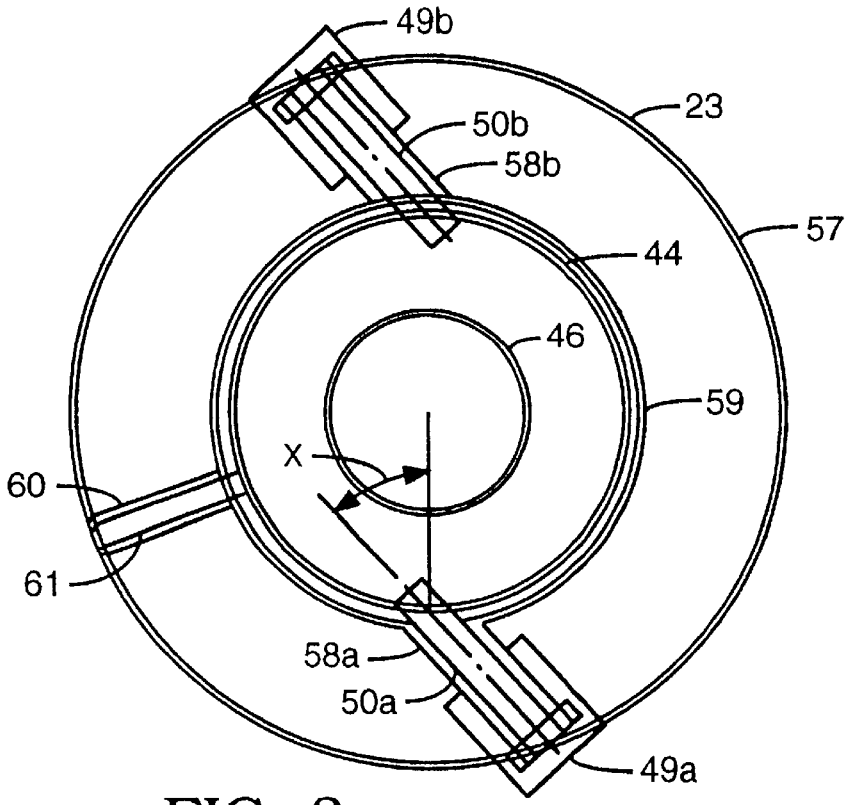
Figure 4:
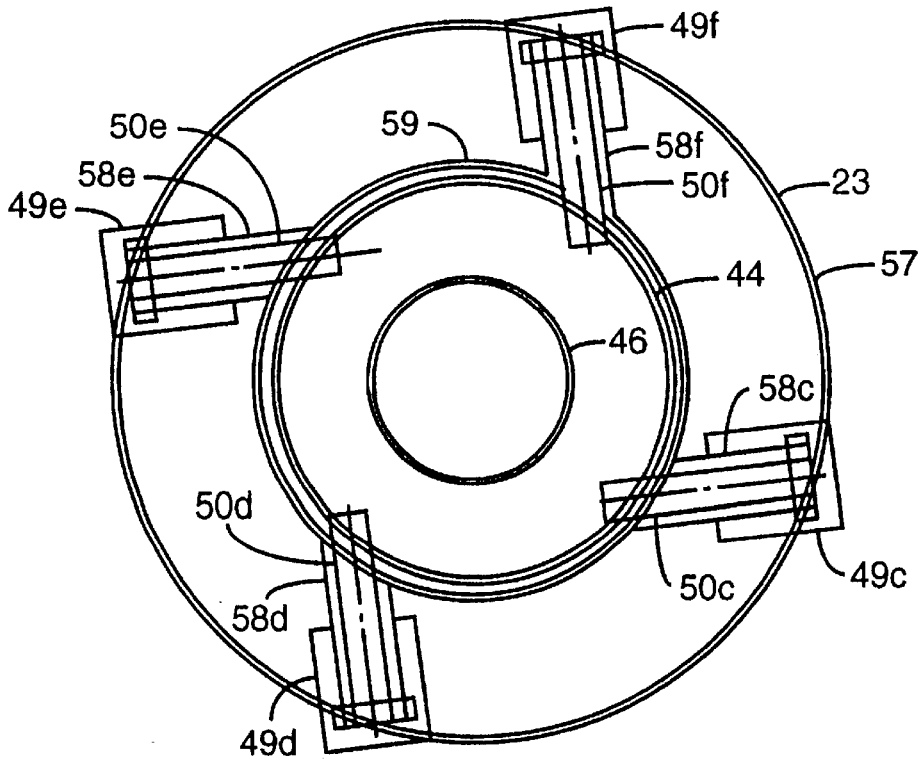
Figure 5:
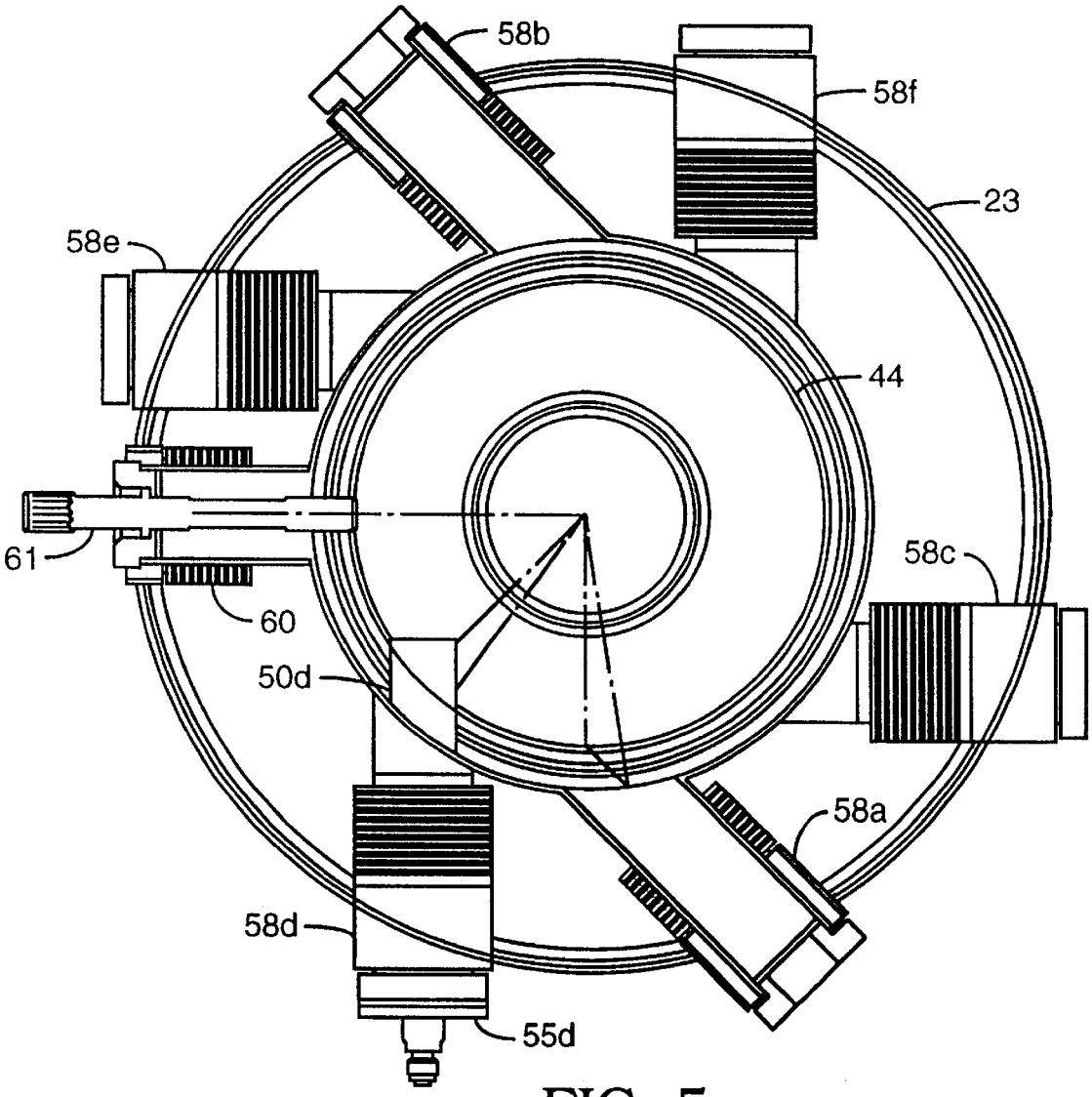
Figures 6, 7:
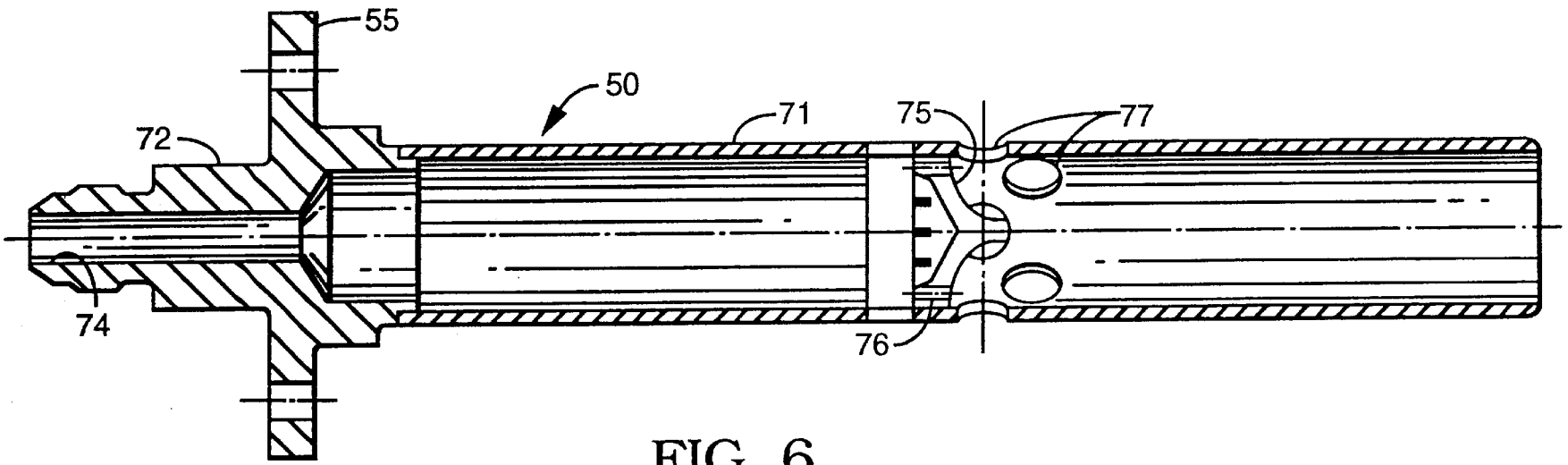

Having thus described the present invention in general terms, reference will now be made to the accompanying drawings in which:

FIG. 1 is a perspective view, partially cut away, of a turbogenerator utilizing the multi-stage, multi-plane, combustion system of the present invention, FIG. 2 is a sectional view of a combustor housing for the multi-stage, multi-plane, combustion system of the present invention;

FIG. 3 is a cross-sectional view of the combustor housing of FIG. 2, including the recuperator, taken along line 3—3 of FIG. 2;

FIG. 4 is a cross-sectional view of the combustor housing of FIG. 2, including the recuperator, taken along line 4—4 of FIG. 2;

FIG. 5 is a partial sectional view of the combustor housing of FIG. 2, including the recuperator, illustrating the relative positions of two planes of the multi-stage, multi-plane, combustion system of the present invention;

FIG. 6 is an enlarged sectional view of a fuel injector for use in the multi-stage, multi-plane, combustion system of the present invention; and FIG. 7 is a table illustrating the four stages or modes of combustion system operation.

DETAILED DESCRIPTION OF THE PREFERRED EMBODIMENTS

The turbogenerator 12 utilizing the low emissions combustion system of the present invention is illustrated in FIG. 1. The turbogenerator 12 generally comprises a permanent magnet generator 20, a power head 21, a combustor 22 and a recuperator (or heat exchanger) 23.

The permanent magnet generator 20 includes a permanent magnet rotor or sleeve 26, having a permanent magnet disposed therein, rotatably supported within a stator 27 by a pair of spaced journal bearings. Radial stator cooling fins 28 are enclosed in an outer cylindrical sleeve 29 to form an annular air flow passage which cools the stator 27 and thereby preheats the air passing through on its way to the power head 21.

The power head 21 of the turbogenerator 12 includes compressor 30, turbine 31, and bearing rotor 32 through which the tie rod 33 to the permanent magnet rotor 26 passes. The compressor 30, having compressor impeller or wheel 34 which receives preheated air from the annular air flow passage in cylindrical sleeve 29 around the stator 27, is driven by the turbine 31 having turbine wheel 35 which receives heated exhaust gases from the combustor 22 supplied with preheated air from recuperator 23. The compressor wheel 34 and turbine wheel 35 are supported on a bearing shaft or rotor 32 having a radially extending bearing rotor thrust disk 36. The bearing rotor 32 is rotatably supported by a single journal bearing within the center bearing housing 37 while the bearing rotor thrust disk 36 at the compressor end of the bearing rotor 32 is rotatably supported by a bilateral thrust bearing.

Intake air is drawn through the permanent magnet generator 20 by the compressor 30 which increases the pressure of the air and forces it into the recuperator 23. The recuperator 23 includes an annular housing 40 having a heat transfer section 41, an exhaust gas dome 42 and a combustor dome 43. Exhaust heat from the turbine 31 is used to preheat the air before it enters the combustor 22 where the preheated air is mixed with fuel and burned. The combustion gases are then expanded in the turbine 31 which drives the compressor 30 and the permanent magnet rotor 26 of the permanent magnet generator 20 which is mounted on the same shaft as the turbine 31. The expanded turbine exhaust gases are then passed through the recuperator 23 before being discharged from the turbogenerator 12.

The combustor housing 39 of the combustor 22 is illustrated in FIGS. 2–5, and generally comprises a cylindrical outer liner 44 and a tapered inner liner 46 which, together with the combustor dome 43, form a generally expanding annular combustion housing or chamber 39 from the combustor dome 43 to the turbine 31. A plurality of fuel injectors 50 extend through the recuperator 23 from a boss 49, through an angled tube 58 between the outer recuperator wall 57 and the inner recuperator wall 59. The fuel injectors 50 then extend from the cylindrical outer liner 44 of the combustor housing 39 into the interior of the annular combustor housing 39 to tangentially introduce a fuel/air mixture generally at the combustor dome 43 end of the annular combustion housing 39 along the two fuel injector planes or axes 3 and 4. The combustion dome 43 is generally rounded out to permit the flow field from the fuel injectors 50 to fully develop and also to reduce structural stress loads in the combustor.

A flow control baffle 48 extends from the tapered inner liner 46 into the annular combustion housing 39. The baffle 48, which would be generally skirt-shaped, would extend between one-third and one-half of the distance between the tapered inner liner 46 and the cylindrical outer liner 44. Two (2) rows each of a plurality of spaced offset air dilution holes 53 and 54 in the tapered inner liner 46 underneath the flow control baffle 48 introduce dilution air into the annular combustion housing 39. The rows of air dilution holes 53 and 54 may be the same size or air dilution holes 53 can be smaller than air dilution holes 54.

In addition, a row of a plurality of spaced air dilution holes 51 in the cylindrical outer liner 44, introduces more dilution air downstream from the flow control baffle 48. If needed, a second row of a plurality of spaced air dilution holes may be offset downstream from the first row of air dilution holes 51.

The low emissions combustor system of the present invention can operate on gaseous fuels, such as natural gas, propane, etc., liquid fuels such as gasoline, diesel oil, etc., or can be designed to accommodate either gaseous or liquid fuels. Examples of fuel injectors for operation on a single fuel or for operation on either a gaseous fuel and/or a liquid fuel are described in U.S. Pat. No. 5,850,732.

Fuel can be provided individually to each fuel injector 50, or, as shown in FIG. 1, a fuel manifold 15 can be used to supply fuel to all of the fuel injectors in plane 3 or in plane 4 or even to all of the fuel injectors in both planes 3 and 4. The fuel manifold 15 may include a fuel inlet 16 to receive fuel from a fuel source (not shown). Flow control valves 17 can be provided in each of the fuel lines from the manifold 15 to each of the fuel injectors 50. The flow control valves 17 can be individually controlled to an on/off position (to separately use any combination of fuel injectors individually) or they can be modulated together. Alternately, the flow control valves 17 can be opened by fuel pressure or their operation can be controlled or augmented with a solenoid.

As best shown in FIG. 3, fuel injector plane 3 includes two diametrically opposed fuel injectors 50*a* and 50*b*. Fuel injector 50*a* may generally deliver premixed fuel and air near the top of the combustor housing 39 while fuel injector 50*b* may generally deliver premixed fuel and air near the bottom of the combustor housing 39. The two plane 3 fuel injectors 50*a* and 50*b* are separated by approximately one hundred eighty degrees. Both fuel injectors 50*a* and 50*b* extend though the recuperator 23 in an angled tube 58*a*, 58*b* from recuperator boss 49*a*, 49*b*, respectively. The fuel injectors 50*a* and 5O*b* are angled from the radial an angle "x" to generally deliver fuel and air to the area midway between the outer housing wall 44 and the inner housing wall 46 of the combustor housing 39. This angle "x" would normally be between twenty and twenty-five degrees but can be from fifteen to thirty degrees from the radial. Fuel injector plane 3 would also include an ignitor cap 60 to position an ignitor 61 within the combustor housing 39 generally between fuel injector 50*a* and 50*b*. At this point, the ignitor 61 would be at the delivery point of fuel injector 50*a*, that is the point in the combustor housing between the outer housing wall 44 and the inner housing wall 46 where the fuel injector 50*a* delivers premixed fuel and air.

FIG. 4 illustrates fuel injector plane 4 which includes four equally spaced fuel injectors 50*c*, 50*d*, 50*e*, and 50*f*. These fuel injectors 50*c*, 50*d*, 50*e*, and 50*f* may generally be positioned to deliver premixed fuel and air at forty-five degrees, one hundred thirty-five degrees, two hundred twenty-five degrees, and three hundred thirty-five degrees from a zero vertical reference. These fuel injectors would also be angled from the radial the same as the fuel injectors in plane 3.

FIG. 5 illustrates the positional relationship of the fuel injector plane 3 fuel injectors 50*a* and 50*b* with respect to the fuel injector plane 4 fuel injectors 50*c*, 50*d*, 50*e*, and 50*f*. The ignitor 61 is positioned in fuel injector plane 3 with respect to fuel injector 50*a* to provide ignition of the premixed fuel and air delivered to the combustor housing 39 by fuel injector 50*a*. Once fuel injector 50*a* is lit or ignited, the hot combustion gases from fuel injector 50*a* can be utilized to ignite the premixed fuel and air from fuel injector 50*b*.

FIG. 6 illustrates a fuel injector 50 capable of use in the low emissions combustion system of the present invention. The fuel injector flange 55 is attached to the boss 49 on the outer recuperator wall 57 and extends through an angled tube 58, between the outer recuperator wall 57 and inner recuperator wall 59. The fuel injector 50 then extends into the cylindrical outer liner 44 of the combustor housing 39 and into the interior of the annular combustor housing 39

The fuel injectors 50 generally comprise an injector tube 71 having an inlet end and a discharge end. The inlet end of the injector tube 71 includes a coupler 72 having a fuel inlet bore 74 which provides fuel to interior of the injector tube 71. The fuel is distributed within the injector tube 71 by a centering ring 75 having a plurality of spaced openings 76 to permit the passage of fuel. These openings 76 serve to provide a good distribution of fuel within the injector tube 71.

The space between the angled tube 58 and the outer injector tube 71 is open to the space between the inner recuperator wall 59 and the cylindrical outer liner 44 of the combustor housing 39. Heated compressed air from the recuperator 23 is supplied to the space between the inner recuperator wall 59 and the cylindrical outer liner 44 of the combustor housing 39 and is thus available to the interior of the angled tube 58.

A plurality of openings 77 in the injector tube 71 downstream of the centering ring 75 provide compressed air from the angled tube 58 to the fuel in the injector tube 71 downstream of the centering ring 75. These openings 77 receive the compressed air from the angled tube 58 which receives compressed air from the space between the inner recuperator wall 59 and the cylindrical outer liner 44 of the combustor housing 39. The downstream face of the centering ring 75 can be sloped to help direct the compressed air entering the injector tube 71 in a downstream direction. The air and fuel are premixed in the injector tube 71 downstream of the centering ring and bums at the exit of the injector tube 71.

Various modes of combustion system operation are shown in tabular form in FIG. 7. The percentage of operating power and the percentage of maximum fuel-to-air ratio (FAR) is provided for operation with different numbers of fuel injectors.

Fuel injectors 50*a* and 50*b* in fuel injector plane 3 are utilized for system operation generally between idle and five percent of power. Either or both of fuel injector 50*a* or 50*b* can operate in a pilot mode or in a premix mode supplying premixed fuel and air to the combustor housing 39. Most importantly, elimination of pilot operation significantly reduces NOx levels at these low power operating conditions.

As power levels increase, the fuel injectors 50*c*, 50*d*, 50*e*, and 50*f* in fuel injector plane 4 are turned on. Fuel injector plane 4 would generally be approximately two fuel injector diameters axially downstream from fuel injector plane 3, something on the order of four to five centimeters. The hot combustion gases from fuel injectors 50*a* and 50*b* in fuel injector plane 3 will be expanding and decreasing in velocity as they move axially downstream in combustor housing 39. These hot combustion gases can be utilized to ignite fuel injectors 50*c*, 50*d*, 50*e*, and 50*f* in fuel injector plane 4 as additional power is required.

For power required between five percent and forty-four percent, any one of fuel injectors 50*c*, 50*d*, 50*e*, or 50*f* can be ignited, bringing the total of lit fuel injectors to three, two in plane 3 and one in plane 4. A fourth fuel injector is ignited for power requirements between forty-four percent and sixty-seven percent and this fuel injector would normally be opposed to the third fuel injector lit. In other words, if fuel injector 50*c* is lit as the third fuel injector, then fuel injector 50*e* would be lit as the fourth fuel injector. For power requirements between sixty-seven percent up to one hundred percent, one or both of the remaining two fuel injectors in plane 4 are lit. As power requirements decrease, fuel injectors can be turned off in much the same sequence as they were turned on.

Alternately, once the fuel injectors 50*a* and 50*b* in plane 3 have been used to start up the system and ignite the fuel injectors 50*c*, 50*d*, 50*e*, or 50*f* in plane 4, one or both of the fuel injectors 50*a* and 50*b* in plane 3 may be turned off, leaving only the fuel injectors 50*c*, 50*d*, 50*e*,or 50*f* in plane 4 ignited.

In this manner, low emissions can be achieved over the entire operating range of the combustion system. In addition, greater combustion stability is provided over wider operating conditions. With the jets from the fuel injectors in plane 3 well dispersed before they reach fuel injection plane 4, a good overall pattern factor is achieved which helps the stability of the flames from the fuel injectors in plane 4. This also enables the four fuel injectors in fuel injector plane 4 to be equally spaced circumferentially, shifted approximately forty five degree from the fuel injectors in plane 3 to allow for greater space between the fuel injector pass throughs.

Adequate residence time is provided in the primary combustion zone to complete combustion before entering the secondary combustion zone. This leads to low CO and THC emissions particularly at low power operation where only the fuel injectors in plane 3 are ignited. The length of the secondary combustion zone is sufficient to improve high power emissions, mid-power stability and pattern factor. The residence time around the first injector plane, plane 3, can be significantly greater than the residence time around the second injector plane, plane 4.

As the hot combustion gases exit the primary combustion zone, they are mixed with dilution air from the inner liner and later from the outer liner to obtain the desired turbine inlet temperature. This will be done in such a way to make the hot gases exiting the combustor have a generally uniform pattern factor.

It should be recognized that while the detailed description has been specifically directed to a first plane 3 of two fuel injectors and a second plane 4 of four fuel injectors, the combustion system and method may utilize different numbers of fuel injectors in the first and second planes. For example, the first plane 3 may include three or four fuel injectors and the second plane 4 may include two or three injectors. Further, regardless of the number of fuel injectors in the first and second planes, a pilot flame may be utilized in the first plane 3 and mechanical stabilization, such as flame holders, can be utilized in the fuel injectors of the second plane 4.

Thus, specific embodiments of the invention have been illustrated and described, it is to be understood that these are provided by way of example only and that the invention is not to be construed as being limited thereto but only by the proper scope of the following claims.

What we claim is:

1. An apparatus comprising:

an annular combustor having an outer liner, an inner liner, a closed upstream end, and an open discharge end;

a first plurality of tangential fuel injectors spaced around the periphery of the closed end of the combustor and disposed in a first axial plane;

a second plurality of tangential fuel injectors spaced around the periphery of the closed end of the combustor and disposed in a second axial plane and between the first axial plane and the open discharge end, wherein each of the first and second pluralities of tangential fuel injectors includes a fuel injector tube, and wherein an axial spacing between the first axial plane and the second axial plane is generally two injector tube diameters; and a plurality of air dilution openings in the inner liner and the outer liner.

2. The apparatus of claim 1 further comprising:

a flow control baffle extending from the inner liner into the annular combustor between the inner liner and the outer liner.

3. The apparatus of claim 2 wherein the plurality of air dilution openings further comprises:

a plurality of air dilution openings in the inner liner and the outer liner between the flow control baffle and the open discharge end.

4. The apparatus of claim 1 wherein the closed end of the annular combustor is generally dome-shaped.

5. The apparatus of claim 1 wherein the plurality spaced air dilution openings in the inner liner include a plurality of rows of offset holes and the plurality of spaced air dilution openings in the outer liner include at least one row of holes.

6. The apparatus of claim 5 wherein the plurality of rows of offset holes in the inner liner is two and the at least one row of holes in the outer liner is one.

7. The apparatus of claim 1, wherein the number of tangential fuel injectors in the first axial plane is two.

8. The apparatus of claim 1, wherein the first plurality of tengential fuel injectors are axially spaced downstream from the second plurality of tangential fuel injectors by a distance of approximately 4 to 5 centimeters.

9. The apparatus of claim 1, wherein the first plurality of tangential fuel injectors are equally spaced circumferentially and the second plurality of tangential fuel injectors are equally spaced circumferentially.

10. The apparatus of claim 9, wherein the second plurality of fuel injectors are shifted a predetermined angle from the first plurality of fuel injectors.

11. The apparatus of claim 10, wherein the predetermined angle is approximately 45 degrees.

12. The apparatus of claim 9, wherein the first plurality of tangetial fuel injectors includes only two fuel injectors.

13. The apparatus of claim 9, wherein the second plurality of tangential fuel injectors includes four fuel injectors.

* * * * *